United States Patent [19]

Steiner

[11] Patent Number: 4,739,888

[45] Date of Patent: Apr. 26, 1988

[54] CLOTHES DRYING APPARATUS

[76] Inventor: Walter Steiner, Saentisstrasse 52, CH-8311 Bruetten, Switzerland

[21] Appl. No.: 89,534

[22] Filed: Aug. 26, 1987

[30] Foreign Application Priority Data

Sep. 15, 1986 [EP] European Pat. Off. ..... 86112736.3

[51] Int. Cl.[4] ..... A47F 5/10

[52] U.S. Cl. ..... 211/198; 211/119.01

[58] Field of Search ..... 211/198, 195, 119.01, 211/104

[56] References Cited

U.S. PATENT DOCUMENTS

| | | | |
|---|---|---|---|
| 886,116 | 4/1908 | Custer | 211/198 X |
| 1,545,072 | 7/1925 | Stearns | 211/198 |
| 1,628,936 | 5/1927 | Turner | 211/198 X |
| 3,132,745 | 5/1964 | Steiner | 211/195 X |

FOREIGN PATENT DOCUMENTS

| | | | |
|---|---|---|---|
| 1585580 | 4/1971 | Fed. Rep. of Germany . | |
| 2922763 | 12/1980 | Fed. Rep. of Germany | 211/195 |

*Primary Examiner*—Robert W. Gibson, Jr.
*Attorney, Agent, or Firm*—Tarolli, Sundheim & Covell

[57] ABSTRACT

The invention provides a clothes drying apparatus comprising a plurality of clothes lines or rods to take the clothes to be dried, extending between parallel running supporting arms which are pivotally mounted on an elongate supporting member. It has a wide scope of use and can be stored in the smallest place if not in use. For this purpose, there is provided an elongate central supporting element which is provided at each end with two supporting arms such that two pairs of supporting arms are formed. Each pair of supporting arms is pivotal around the central axis of the elongate supporting element and can be locked in its position. Furthermore, the supporting arms are pivotal by twos around perpendicular axes from an extended position in which they enclose an angle of essentially 90° with the central supporting member, to a closed position in which they run essentially parallel to the central supporting element.

6 Claims, 4 Drawing Sheets

1
2
3
4
7
8
9
X
Y
8a
9a
11a
11b

CLOTHES DRYING APPARATUS

BACKGROUND OF THE INVENTION

1. Field of the Invention

The present invention refers to a clothes drying apparatus having a central, elongate supporting member and two pairs of parallel running supporting arms. Between two supporting arms of a pair extend several clothes lines or rods which serve to take the clothes to be dried. Thus, two frame-like structures are formed which are pivotal with respect to each other about the central axis of the elongate supporting member.

2. Prior Art

A clothes drying apparatus of the kind referred to above is well known and widely used. An example is disclosed in Published German Patent Application No. 1,585,580. It has the advantage that its shape can be adapted according to the intended use: If it is to be put on the floor or above a bath tub, the two frame-like structures are folded together to enclose a relatively acute angle, or if it is to be put against a wall, the two frame-like structures are unfolded to enclose an angle of almost 180°. If not in use, the two frame-like structures may be completely folded together, one towards the other, resulting in an almost flat piece of apparatus taking less space when stored.

OBJECTS OF THE INVENTION

It is an object of the invention to further improve a clothes drying apparatus of the kind referred to. Particularly, it is an object of the invention to provide a clothes drying apparatus which can be folded together such that it requires considerably less space than a clothes drying apparatus of the prior art. It is a still further object of the invention to provide a clothes drying apparatus which can be used in a wide variety of applications.

SUMMARY OF THE INVENTION

The clothes drying apparatus of the invention comprises a central, elongate supporting member, a first pair of supporting arms running essentially parallel to each other and a second pair of supporting arms running essentially parallel to each other. A first end of each supporting arm of the first pair is connected to the supporting member in the region of one of the two free ends thereof and a first end of each supporting arm of the second pair is connected to the supporting member in the region of the other one of the two free ends thereof.

A first plurality of clothes lines or rods extends between the supporting arms of the first pair of supporting arms, and a second plurality of clothes lines or rods extends between the supporting arms of the second pair of supporting arms.

The first and second pairs of supporting arms mounted on the supporting member are pivotal with respect to each other around the central longitudinal axis of the supporting member and can be locked in a desired position.

The supporting arms of the first and second pairs of supporting arms are further pivotal in twos about second axes from a first, extended position in which they enclose an angle of essentially 90° with said central supporting member, into a second, closed position in which they run essentially parallel to the central supporting member, and vice versa.

The elongate, central supporting member may include two profile members running parallel side by side which are pivotally connected to each other. Preferably, the two profile members each comprise connecting means mounted at the free ends of each profile member, said connecting means each including a protruding bracket adapted to pivotally connect the two profile members to each other.

In a preferred embodiment, the supporting arms are pivotally mounted about said second axes on the aforementioned connecting means, said second axes extending perpendicularly to the central axis of the elongate supporting member.

In order to improve the rigidity of the clothes drying apparatus, particularly if flexible clothes lines are used, the second ends of the supporting arms of the first pair of supporting arms may be connected to each other by a first connecting member and the second ends of the supporting arms of the second pair of supporting arms may be connected to each other by a second connecting member, thereby forming first and second parallelogram-like collapsible frames.

In order to improve the stability of standing of the clothes drying apparatus, the second ends of the supporting arms and/or the first and second connecting members can be provided with fork-like, preferably anti-glide base members.

BRIEF DESCRIPTION OF THE DRAWINGS

In the following, an embodiment of the clothes drying apparatus of the invention will be described in more detail, with reference to the accompanying drawings, in which.

DESCRIPTION OF A PREFERRED EMBODIMENT

Figure 2:
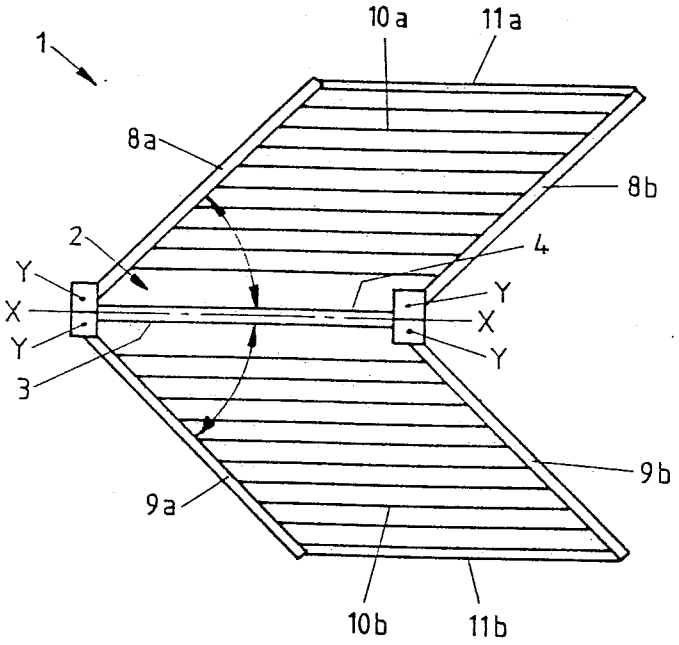
FIG. 2 shows a schematic top view of the clothes drying apparatus in its partially closed, unfolded position.

The clothes drying apparatus, generally designated with reference numeral 1, comprises an elongate, central supporting element 2. According to the preferred embodiment shown in the drawings, the supporting element 2 is constituted by two profile members 3 and 4 made of aluminium, running parallel side by side. The two free ends of each profile member 3 and 4 is provided each with a connecting member 5*a*, 5*b* and 6*a*, 6*b*, respectively, which can be made, for instance, of plastic material. Each connecting member has a laterally projecting bracket 7. Each two adjacent brackets 7 of associated connecting members 5*a*, 5*b* and 6*a*, 6*b*, respectively, are connected to each other by suitably (not shown) connecting means, e.g. screws and nuts, bolts, rivets etc., such that two associated connecting members 5*a*, 5*b* and 6*a*, 6*b*, respectively can be pivoted with reference to each other, as shown in FIGS. 4 to 6.

The main purpose of the connecting members 5*a*, 5*b* and 6*a*, 6*b*, respectively, is to receive, on the one hand, supporting arms 8*a*, 8*b*, 9*b*, 9*b* and, on the other hand, the elongate, central supporting element 2, constituted by the two profile members 3 and 4. The free ends of the supporting arms 8*a* and 8*b* are interconnected by an elongate connecting member 11*a*, and the free ends of the supporting arms 9*a* and 9*b* are interconnected by an elongate connecting member 11*b*. The connecting members 11*a* and 11*b* can be constituted by aluminium profile members as well. Thus, two frame-like structures are formed, a first one comprising the profile member 4 which is part of the elongate, central supporting member 2, the two connecting members 5*b* and 6*b*, the two parallel running supporting arms 8*a* and 8*b* and the connecting member 11*a*, and a second one comprising the profile member 3 which is part of the elongate, central supporting member 2, the two connecting members 5*a* and 6*a*, the two parallel running supporting arms 9*a* and 9*b* and the connecting member 11*b*.

A plurality of clothes lines or rods 10*a*extends between the first pair of supporting arms 8*a* and 8*b*, and a plurality of clothes lines or rods extends between the second pair of supporting arms 9*a* and 9*b*.

Figure 1:
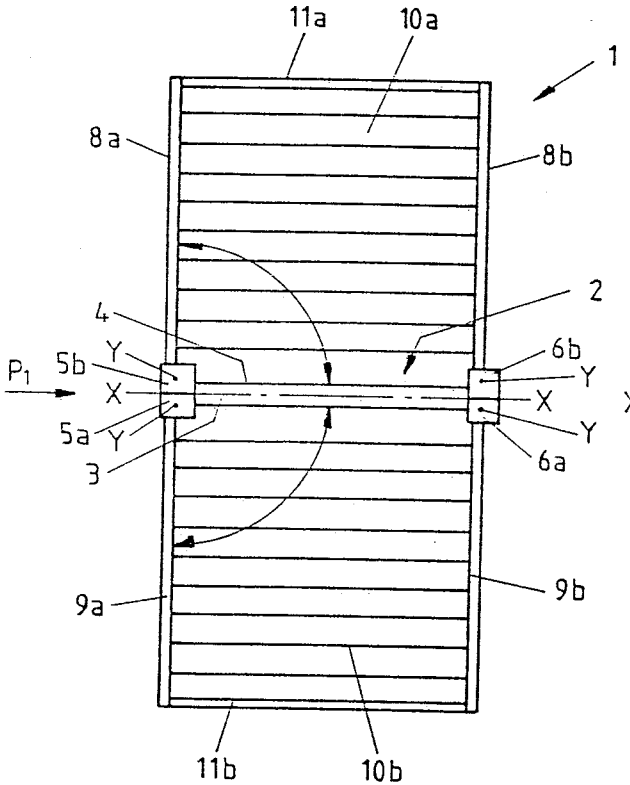
FIG. 1 shows a schematic top view of the clothes drying apparatus in its open, unfolded position.
Figures 3, 4, 5, 6, 7:
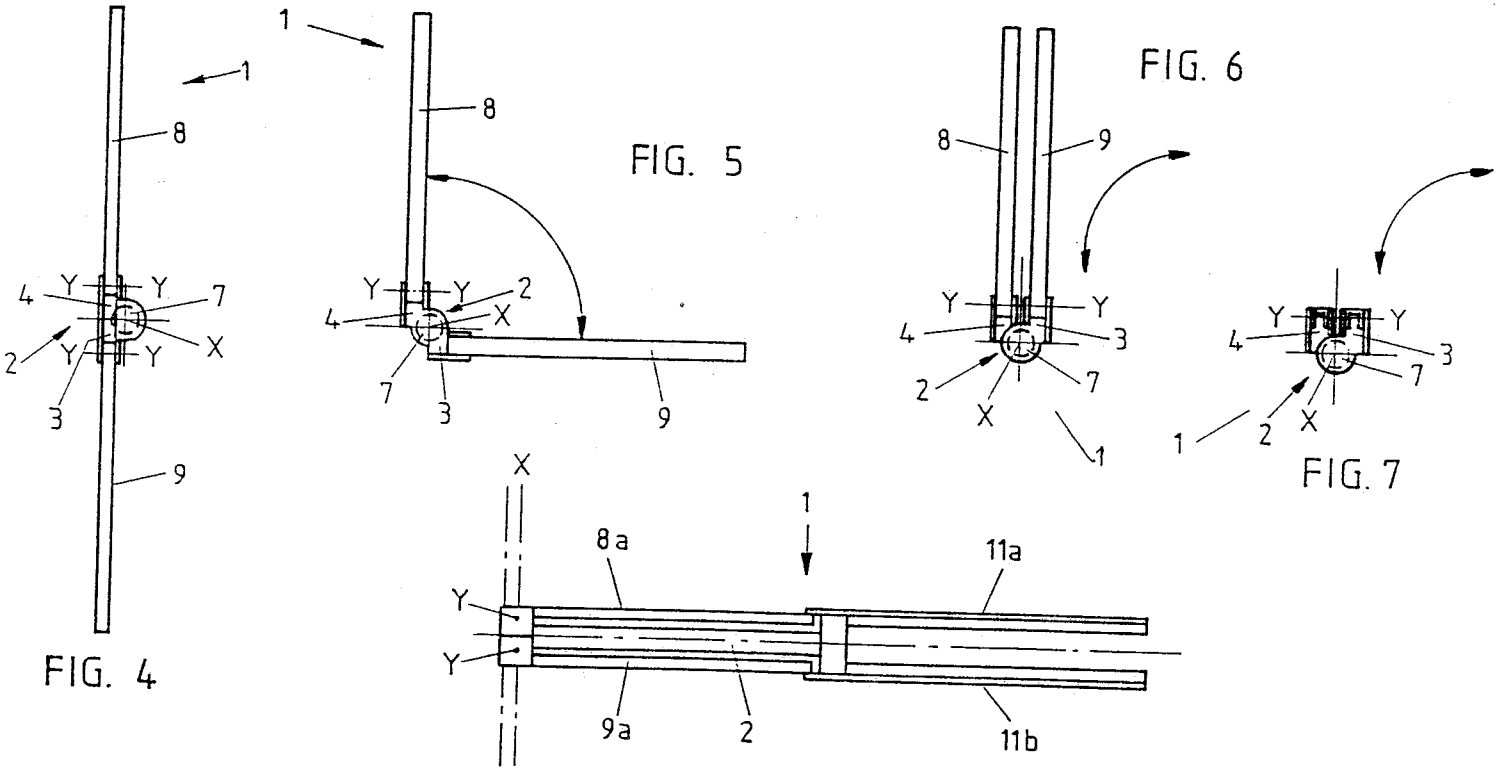
FIG. 3 shows a schematic top view of the clothes drying apparatus in its fully closed, unfolded position.
FIG. 4 a schematic side view of the clothes drying apparatus in the direction of arrows $P_1$ in FIG. 1.
FIG. 5 a schematic side view, similar to FIG. 4, but in partially folded position.
FIG. 6 a schematic side view, similar to FIG. 4, but in fully folded position.
FIG. 7 a schematic side view, similar to FIG. 4, but in fully folded and fully closed position.

According to FIGS. 4 to 6, the first frame-like structure, incorporating the first pair of supporting arms 8*a* and 8*b* and designated 8 in the above mentioned Figs., and the second frame-like structure, incorporating the supporting arms 9*a* and 9*b* and designated 9 in the above mentioned Figs., are pivotal with respect to each other about an axis X. This axis X essentially coincides with the central longitudinal axis of the elongate central supporting member 2, with other words, it extends symmetrically between the two profile members 3 and 4. Thus, the two frame-like structures 8 and 9, constituting the two halves of the clothes drying apparatus, may be continuously folded together from an unfolded position (FIGS. 1 and 4) via a partially folded position (FIG. 5) into a fully folded position (FIG. 6).

Furthermore, the supporting arms 8*a*, 8*b*, 9*a* and 9*b* are pivotally received in the associated connecting members 5*a*, 5*b*, 6*a* and 6*c*; the pivoting movement is thereby effected about axes Y which all extend perpendicularly to the aformentioned axis X.

As the connecting members 11*a* and 11*b* are also pivotally mounted on the ends of the arms 8*a*, 8*b* and 9*a*, 9*b*, respectively, the frame-like structures 8 and 9, respectively, may be brought from an open position (FIG. 1), in which the supporting arms 8*a*, 8*b* and 9*a*, 9*b*, respectively, extend essentially perpendicularly to the elongate central supporting element 2, via a partially closed position (FIG. 2) to a fully closed position (FIG. 3), in which the supporting arms 8*a*, 8*b* and 9*a*, 9*b*, respectively, run essentially parallel to the elongate central supporting member 2.

As can be seen from FIGS. 3 and 7, a clothes drying apparatus 1 according to the invention requires but a very limited space when stored if the two frame-like structures, incorporating the supporting arms 8*a*, 8*b* and 9*a*, 9*b*, respectively, are folded together and additionally fully closed, since the clothes drying apparatus essentially takes the shape of a elongate body in this position, with the supporting arms 8*a*, 8*b* and 9*a*, 9*b*, respectively, running essentially parallel to the profile members 3 and 4 constituting the elongate central supporting member 2.

It is understood that the associated and cooperating connecting members 5*a*, 5*b* and 6*a*, 6*b*, respectively, are pivotally connected to each other by suitable means well known in the art (not shown) such that the clothes drying apparatus can be locked in any arbitrary positon of the two frame-like structures with respect to each other. For instance, this can be accomplished by means of clamping screws or other suitable means which have not to be discussed here. Similarly, (not shown) further locking means may be provided to lock the supporting arms 8*a*, 8*b* and 9*a*, 9*b*, respectively, in their position, be it in their opened position according to FIG. 1, be it in their closed position according to FIG. 3.

Figure 9:
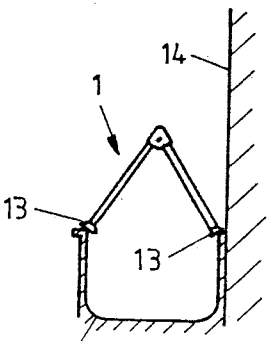
Figure 8:
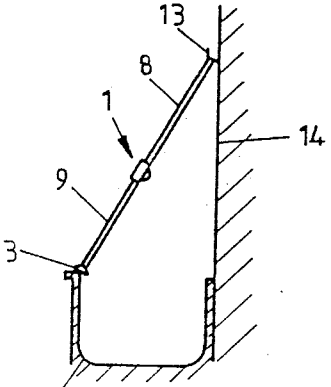

The possibilities of use of the clothes drying apparatus according to the invention are particularly manifold. According the FIG. 8, the clothes drying apparatus 1 can be put over a bath tub 12, whereby the ends of the supporting arms 8 and 9 in each case can be provided with anti-glide and/or fork-like base members 13. The structure of the clothes drying apparatus is thereby supported by the edge of the bath tub 12 and the wall 14 and is in its unfolded, open position according to FIG. 1. As is shown in FIG. 9, the clothes drying apparatus 1 may be used over a bath tub 12 even in a partially folded position. Thereby, the base members 13 rest on opposite upper edges of the bath tub 12.

Figure 10:
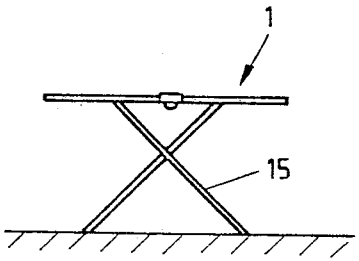
FIGS. 8–17 schematic views of the clothes drying apparatus of the invention to illustrate different modes of application.
Figure 12:
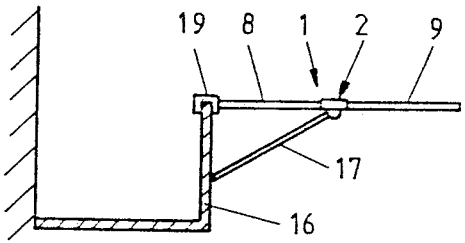
Figure 11:
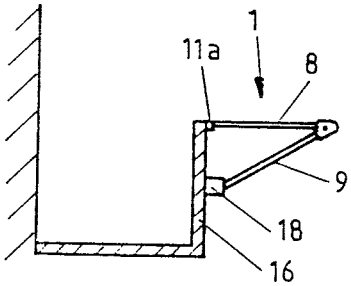

According to FIG. 10, a supporting frame 15 may be provided in order to enable the clothes drying apparatus to be freely arranged. It is understood that, in contrary to the example shown in the drawing, a central supporting post with a base member may be used as well. FIGS. 11 and 12 show two possibilities to mount the clothes drying apparatus 1 on the balustrade 16 of a balcony. In the situation shown in FIG. 11, in which the clothes drying apparatus 1 takes a nearly fully folded position, hook-like anchoring members (not shown) are provided which engage the connecting member 11*a* at the ends of the supporting arms 8. The supporting arms 9, however, rest via an intermediate member 18 on the balustrade 16. According to FIG. 12, the clothes drying apparatus 1 is in its unfolded position again, whereby the ends of the supporting arms 8 are connected to the upper edge of the balustrade 16 of the balcony by means of clamping elements 19. A supporting strut 17 which supports the elongate central supporting member 2 provides the required stability of the clothes drying apparatus 1.

Figure 14:
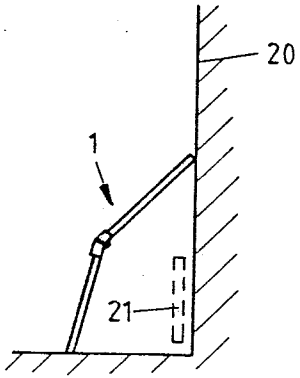
Figure 13:
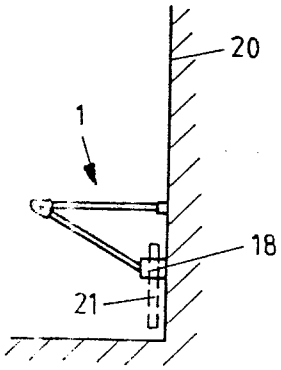
Figure 15:
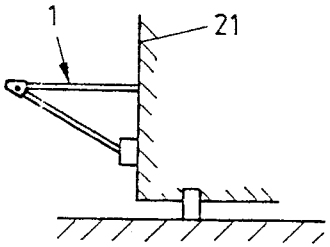

In a manner similar to the one shown in FIG. 11, the clothes drying apparatus 1 may be fastened to a wall 20, e.g. at the top of a heater 21, as shown in FIG. 13. In this situation, an intermediate member 18 is required as well. A corresponding mode of use, i.e. on a wall 20 over a heater 21, is shown in FIG. 14; The clothes drying apparatus is nearly fully unfolded and rests on the wall 20 and on the floor. According to FIG. 15, the clothes drying apparatus may be fastened to the outer wall 21 of a caravan instead to the balustrade of a balcony.

Figure 16:
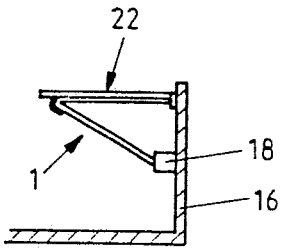
Figure 17:
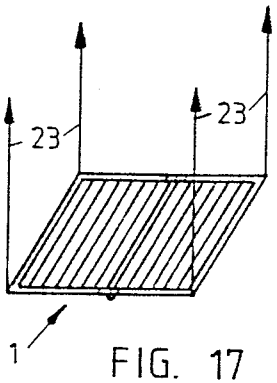

As is shown in FIG. 16, the clothes drying apparatus 1 may also be used as a support for a balcony table. For this purpose, it is brought into its nearly fully folded position and fastened to the inner side of a balustrade 16 of the balcony. The lower frame-like structure rests via an intermediate member 18 on the balustrade 16 and the upper, essentially horizontal frame-like structure supports a table-board 22. FIG. 17 illustrates that the clothes drying apparatus 1 may be suspended by means of ropes or wires 23, whereby the apparatus is preferably in its fully unfolded position.

Only a few modes of use have been shown hereinabove; the possibilities to use the clothes drying apparatus of the invention are nearly unlimited. In this connection, it must be remembered that the clothes drying apparatus of the invention can be easily and quickly folded together and closed at any time in order to be stored as a narrow, elongate body as shown in FIGS. 3 and 7 even in a small locker.

What I claim is:

1. A clothes drying apparatus comprising a central, elongate supporting member;

a first pair of supporting arms running essentially parallel to each other, a first end of each supporting arm of said first pair being connected to said supporting member in the region of one of the two free ends thereof;

a second pair of supporting arms running essentially parallel to each other, a first end of each supporting arm of said second pair being connected to said supporting member in the region of one of the two free ends thereof;

a first plurality of clothes lines or rods extending between said supporting arms of said first pair of supporting arms, and a second plurality of clothes lines or rods extending between said supporting arms of said second pair of supporting arms;

said first pair of supporting arms and said second pair of supporting arms mounted on said supporting member being pivotal with respect to each other around a first axis which is the central longitudinal axis of said supporting member, and lockable in their position; and said supporting arms of said first pair of supporting arms and said supporting arms of said second pair of supporting arms being pivotal in twos about second axes from a first, extended position in which they enclose an angle of essentially 90° with said central supporting member, into a second, folded position in which they run essentially parallel to said central supporting member, and vice versa.

2. A clothes drying apparatus according to claim 1, in which said elongate, central supporting member includes two profile members running parallel side by side and pivotally connected to each other.

3. A clothes drying apparatus according to claim 2, in which said two profile members each comprise connecting means mounted at the free ends of each profile member, said connecting means each including a protruding bracket adapted to pivotally connect said two profile members to each other.

4. A clothes drying apparatus according to claim 3, in which said supporting arms are pivotally mounted about said second axes on said connecting means, said second axes extending perpendicularly to said central axis of said central supporting member.

5. A clothes drying apparatus according to claim 1, in which the second ends of the supporting arms of said first pair of supporting arms are connected to each other by a first connecting member and the second ends of the supporting arms of said second pair of supporting arms are connected to each other by a second connecting member, thereby forming first and second parallelogram-like collapsible frames.

6. A clothes drying apparatus according to claim 1 and 5, in which said second ends of said supporting arms and/or said first and second connecting members are provided with fork-like, preferably anti-glide base members.

* * * * *